US006290084B1

(12) United States Patent
Louie

(10) Patent No.: US 6,290,084 B1
(45) Date of Patent: Sep. 18, 2001

(54) ROTARY PROTECTIVE COVER ATTACHMENT FOR BEVERAGE CONTAINER

(75) Inventor: Chun Chiu Louie, 8503 Legation Rd., New Carrollton, MD (US) 20784

(73) Assignee: Chun Chiu Louie, New Carrollton, MD (US)

( * ) Notice: Subject to any disclaimer, the term of this patent is extended or adjusted under 35 U.S.C. 154(b) by 0 days.

(21) Appl. No.: 09/506,020

(22) Filed: Feb. 17, 2000

(51) Int. Cl.[7] ..... B65D 17/34; B65D 51/20; B65D 51/24

(52) U.S. Cl. ..... 220/256; 220/257; 220/258; 220/270; 220/906

(58) Field of Search ..... 220/256, 253, 220/254, 258, 259, 257, 265, 266, 268, 269, 270, 271, 272, 273, 906

(56) References Cited

U.S. PATENT DOCUMENTS 4,717,039 * 1/1988 Ayyoubi ..... 220/253
4,852,763 * 8/1989 Dimberio ..... 220/253
5,199,591 * 4/1993 Thibeault et al. ..... 220/253
5,269,432 * 12/1993 Beckertgis ..... 220/253
5,351,853 * 10/1994 Shock ..... 220/258 X
5,813,559 * 9/1998 Cho ..... 220/258
6,015,059 * 1/2000 Takayama ..... 220/258
6,032,816 * 3/2000 Martin ..... 220/258
6,158,608 * 12/2000 Schlattl ..... 220/253

* cited by examiner

*Primary Examiner*—Allan N. Shoap
*Assistant Examiner*—Niki M. Eloshway
(74) *Attorney, Agent, or Firm*—Chun Chiu Louie

(57) ABSTRACT

A rotatable circular beverage can rim cover having an up-standing loop-shaped outer periphery configured to receive and snap over a raised circular edge of a beverage can. The protective cover serves two main purposes. It is intended to provide a sanitary covering means and to prevent contaminating objects from entering the can after opening. The cover has a circular depressed planar area that has a detachable pull-ring segment assembly covering the punch key portion of a beverage can. Upon the removal of the section by pulling and removing the pull-ring assembly, the protective cover creates an opening through which the contents of the beverage container can be consumed. The remaining section of the protective cover can be rotated between an opened or closed position to all consumption of the soft drink when in an opened position, and to cover the container's opening to prevent insects and other contaminants from penetrating the beverage can when in the closed position. The protective cover also provides an inclining hill-shaped projection to assist in lifting the underside of the punch key to an altitude that allows operator to safely lift the punch key in opening process.

6 Claims, 4 Drawing Sheets

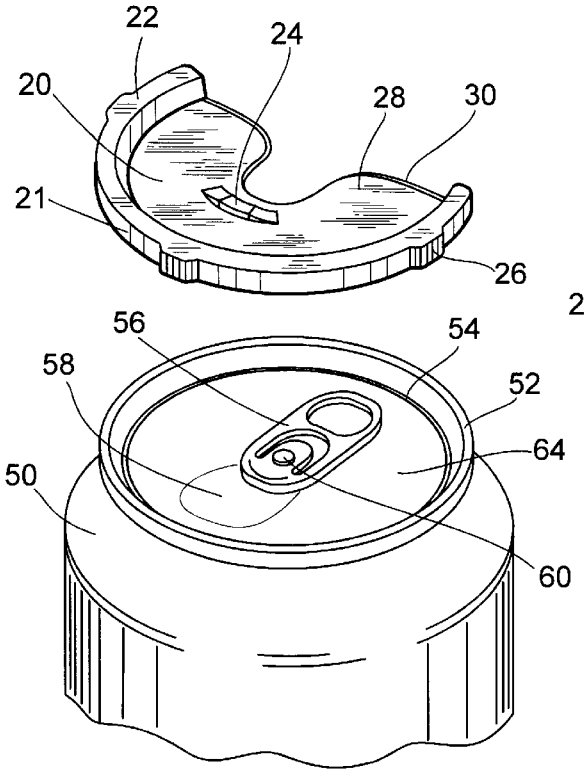
FIG. 1
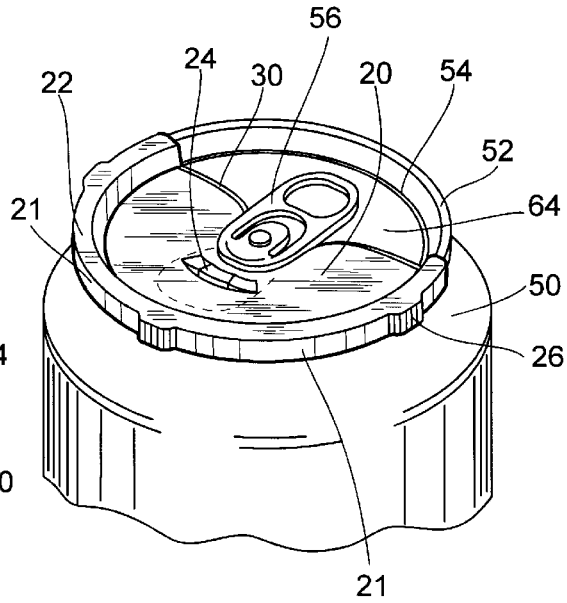
FIG. 2
FIG. 2A
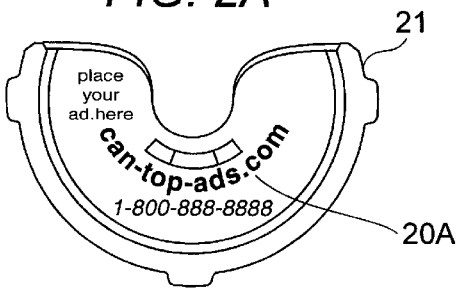

ROTARY PROTECTIVE COVER ATTACHMENT FOR BEVERAGE CONTAINER

BACKGROUND OF INVENTION

1. Field of Invention

This invention relates to a snap-on rotary protective top cover or attachment for a conventional beverage container. The present invention is also designed as a final factory add-on product at the manufacturing plant.

2. Description of Prior Art

The aluminum-type can of the pull-tab type has long been the standard container-dispenser. Soft drinks, beer, fruit and vegetable juices are commonly packaged in such containers. However, none of them provide a protective cover from the manufacturer to protect the consumers from possible contamination. In fact, the conventional pull-tab type beverage container suffers at least three disadvantages that is what the present invention attempts to solve. First, most of us simply pull the tab to open a beverage can and directly drink from it the can. This is ignoring the fact that the outside of the can, including the region of the opening where the lips must be placed for drinking, is rarely sanitary. Although the exterior of the container may have been reasonably clean upon leaving the factory assembly line, dust, dirt, bacteria and viruses can all contaminate the drinking area after entering a processing chain that can include numerous commercial and personal handling. Second, a conventional pull-tab type beverage can lacks a resealing mechanism once it is opened. The problem of insects, particularly bees, entering sugar-sweetened soft drink or the like, and airborne contamination from wind-blow dust and dirt are common, particularly when such drinks are consumed outdoors. Third, in many cases of pop-top cans, the punch key that is used to separate the flap from the top along the predefined scored boundary, is usually secured to a center rivet pin and laying parallel to the can's surface. In order to lift the punch key, one must use a fingertip to hook onto the punch key's underside and pull upwardly. This is particularly difficult for people who have long fingernails. Moreover, attempting to use the fingertip to lift the key in opening a beverage can is rarely a pleasant experience, although it is not typically a painful one. Numerous attempts have been made to provide a protective cover for soft drinks in the past. However, most of them suffer drawbacks one way or another. For example, most of the prior art devices are not manufacturer provided but optional add-on products by the users; it is very inconvenient to carry along a piece of beverage can cover wherever one goes. Also, most of the manufacturers are not apt to replace the existing pull-tab type beverage can top, because it is not economic to make major alterations at the manufacturing plant.

SUMMARY OF THE INVENTION

The present invention overcomes the limitations and difficulties mentioned above with respect to prior art devices by providing a protective cover for beverage cans which is more convenient, versatile, and more efficient than such prior art devices. The rotary protective cover comprises of a depressed semi-circular plate having a cutout portion aligned to the punch key of a beverage can. The protective cover also provides a raised peripheral rim to be coupled with the up-standing ridge of a beverage can, in such a way that the semi-circular dish-shaped cover can be axially rotated along with the raised circular edge of the can. By rotating along the up-standing peripheral rim of the can, the cover dish thus functions as a rotary door to provide opened and closed positions for the can's opening. The protective cover dish is further retained by the can's top surface by means of having a downward projecting filler to fill the curvature of the groove located at the inner periphery of the can. The rotary protective cover also provides an up-standing outer peripheral rim that is bent downwardly and inwardly at the can's under-edge to form a grip. Located near the center of the cover surface yet opposite to the protective cover's opening portion stands a graduated inclining hill-shaped member that functions as a pryer for the punch key of a beverage can. The rotating action of the cover dish enables the raised member to slide under the punch key, which is used for pushing the perforated closure into the can's interior, and causes the lifting end of the punch key to raise at an altitude. Thus, the widening gap between the lever key and the can's surface, which resulted from the punch key's prying action, provides extra space for the fingertip to access with the punch key. And people who are with long fingernails will find this feature particularly beneficial.

According to the present invention the rotary protective cover is generally manufactured of one-piece thermoplastic-formed plastic or molded aluminum, which can be directly pressed onto the top of a beverage can along the assembly line.

The primary object of the present invention is to provide a protective closure to cover the drinking area for sanitary means.

Another object of the present invention is to provide a rotary covered closure to function as a rotary door. In an opened position, the protective cover allows one to consume the contents inside the beverage can, and a closed position covers the opening of the beverage can to prevent insects or other forms of external contamination from entering the interior of the can.

Another object of the present invention is to provide a graduated inclining raised member on the cover's surface to assist in the lifting of the free end of the punch key in the operation of opening a can.

Another object of the present invention is to provide a one-piece constructed protective cover of the beverage can that can be manufactured inexpensively, to employ without requiring change to the present can's physical designs, and can be easily pressed or snapped onto the top of a conventional beverage yet without effecting the stackability and packing of cans.

Still another object of the present invention is to create a novel and efficient location for advertising means, where message can be easily seen by the eyes.

BRIEF DESCRIPTION OF THE DRAWINGS

FIG. 1 is a perspective view of a rotary protective cover of the present invention before it is applied to the top of a beverage can.

FIG. 2 is a perspective view of the present invention after it is engaged to the top of a beverage can.

FIG. 2A is an illustration of the top view of a rotary protective cover having a sample advertisement message imprinted on it.

DETAILED DESCRIPTION OF THE INVENTION

The protective cover for beverage can of the present invention can be produced by thermoplastic or soft metal such as aluminum. Without any modification of the existing beverage can tops on the market, the one-piece constructed protective cover 21 as seen in FIG. 1 can be easily pressed onto a beverage can's top 64 to become an integral part of the beverage can 50 as seen in FIG. 2. The present invention of a protective cover is designed to be installed by the manufacturer before it leaves for packaging or delivery in order to achieve the optimal sanitary means.

FIG. 2A is an illustration of the present invention of a rotary protective cover 21 having a sample advertisement message 20A imprinted on its surface. Since the advertising message is located at the top of the protective cover plate, one must look at the cover and rotate it before drinking. Hence, the protective cover efficiently presents a new location for placing an advertising message that can be easily seen by the eyes.

Figure 3:
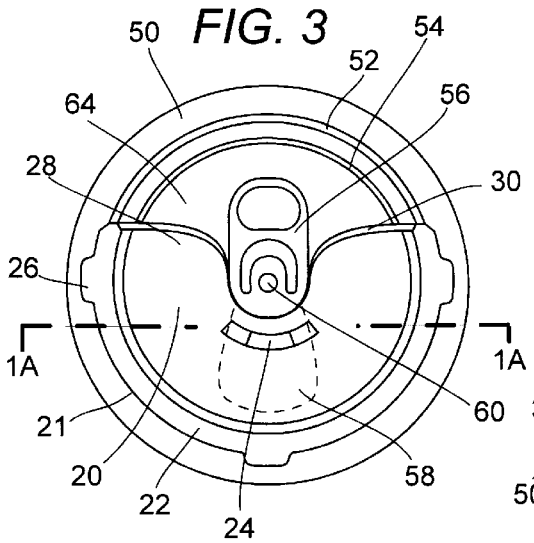
FIG. 3 is a top view of the present invention embodying the top of a beverage can.

Referring to FIG. 3, the protective cover 21 is composed of a semi-circular dish and a planar surface 20 having a cutout portion for receiving the can's punch key 56 of a beverage can. The primary purpose of the cutout portion is to provide an opened area for the mouth to consume the contents inside the container. The semi-circular dish-shaped cover 21, which includes a peripheral sidewall 22 for engaging with the raised circular edge 52 of a beverage can top 64, is constructed in such a way that it can be axially rotated along the beverage can edge 52. The dish-shaped protective cover 21 also provides a number of grasping bodies 26 projected from the side of the peripheral rim for the purpose of maintaining a grip. As seen in FIG. 3, most of the beverage can's top surfaces 64, particularly in the drinking areas including the can edge 52, where the lips must be in contact with while drinking, are covered and protected by the semi-circular dish-shaped cover 21. Since the semi-circular dish-shaped cover 21 must be rotated to expose the drinking area before drinking, the area that is covered by the protective cover 21 remains clean, and thus preventing it from potential contamination resulting from interpersonal handling, transportation, or storage.

Figure 4:
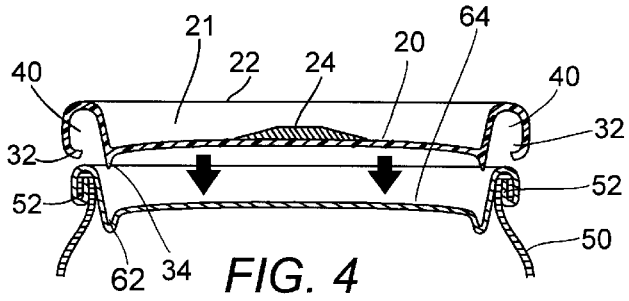
FIG. 4 is a cross-sectional view taken along lines 1A,1A of FIG. 3 showing the protective cover of the present invention about to be engaged with a beverage can top.
Figure 5:
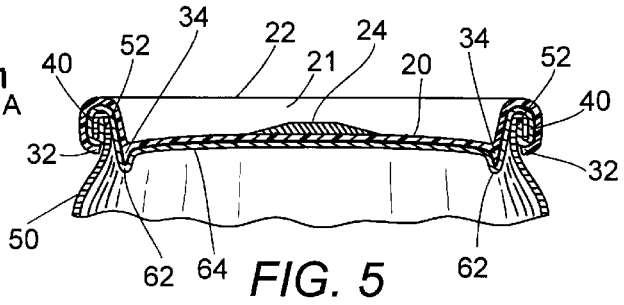
FIG. 5 is the final result of FIG. 4 after engagement is complete.
Figure 6:
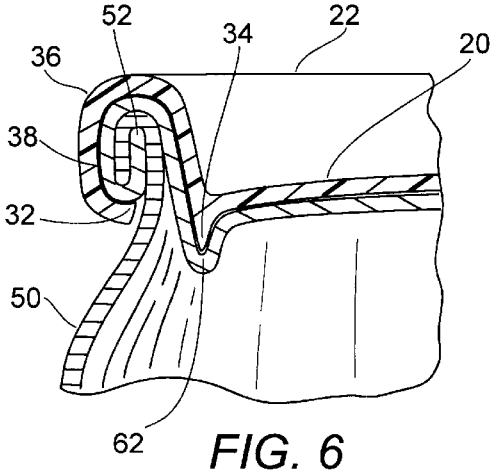
FIG. 6 is a sectional enlargement of FIG. 5, illustrating the embodiment between the present invention and the top of a beverage can.

FIGS. 4–6 are the cross-sectional diagrams to illustrate the structures of the present invention.

Referring to FIG. 4, which is a cross-sectional view of the present invention, taken along lines 1A,1A of FIG. 3. The protective cover 21 comprises of a depressed semi-circular planar surface 20 and a raised outer periphery or sidewall 22 configured to receive the raised edge 52 of a pull-tab type beverage can 50. Amidst the planar surface stands a hill-shaped inclining body 24 which acts as a pryer for prying the punch key 56 of the beverage can upward when the protective cover 21 is being rotated.

As shown in FIG. 4, the protective cover 21 of the present invention includes a planar surface 20 shaped to conform to the contour of the can lid surface 64 and a sidewall extended axially inwardly to form an opening groove 40. The cover dish 21 can be engaged with the can lid 64 by aligning the can edge 52 with the groove 40 of the cover dish. This results for the two to progressively fit together with the yielding softness of the plastic to allow the can edge 52 to be nested in the groove 40.

Figure 7:
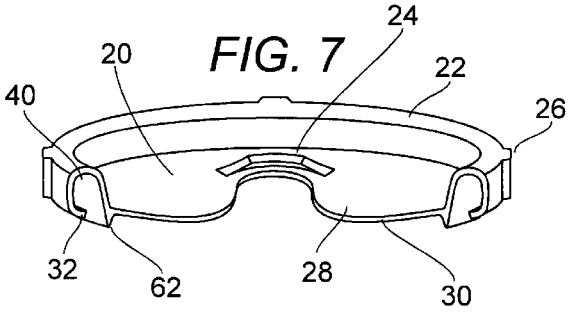
FIG. 7 is a perspective view of the present invention from another elevated viewing angle.
Figure 8:
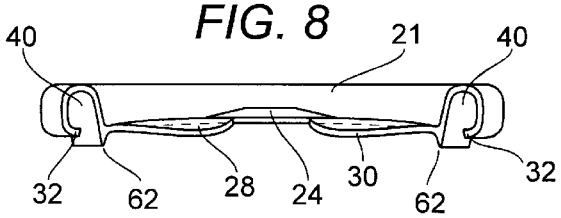
FIG. 8 is a side view of the FIG. 7.

Referring to FIGS. 4–6, the protective cover 21 of the present invention is being attached to a beverage can 50 by aligning the protective cover 21 atop the beverage can 50 and pressing firmly axially downward to form a secure lock. It is also noted that the fitting between the protective cover 21 and can lid 64 should be slightly spaced but not loosely to allow the protective cover 21 to be axially rotated along the can edge 52. To further secure the locking mechanism during the engaging of the protective cover 21 and beverage can edge 52, a V-shaped extended body 34 projecting from the underside at the joint of plate surface 20 and sidewall 22 is formed to fill the curved groove 62 in the vicinity of the can edge 52. The extended body 34 also serves as a blocker to prevent foreign contamination from entering the areas that is covered by the protective cover 21. Referring to FIGS. 7 & 8, which are the perspective views of the present invention at different viewing angles. The cutout portion on the semi-circular dish-shaped cover 20 includes a rounded cutout opening at the center to fit the contour of a punch key 56. The opening gradually extended to a widening curved cutout to fit the human lips. The curveshaped cutout on the cover plate 20 forms a flap 28 on each side on the opening. Flaps 28 on both sides are slightly bent downwardly to press against the top lid surface 64 to ensure a better seal, keeping out dirt as well to restrain the protective cover 21 from accidentally movement.

FIGS. 9–13 are a series of diagrams illustrating the operation of the present inventions.

Figure 9:
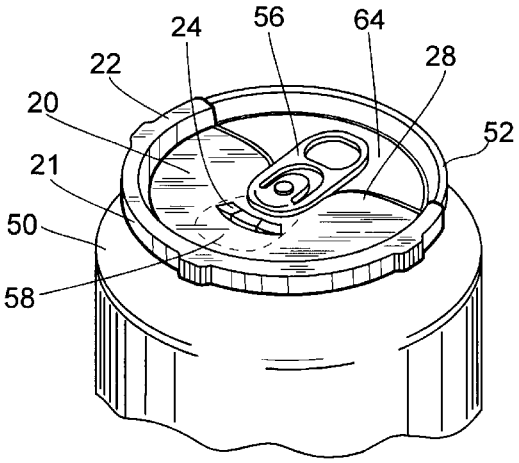
FIG. 9 is the same as FIG. 2, showing the original position of the protective cover, where the drinking area is covered by the present invention for protecting from possible contamination.

FIG. 9 illustrates the original position of the protective cover of the present invention being installed by the manufacturer, which covers the drinking area of a beverage can top cover when it leaves the factory.

Figure 10:
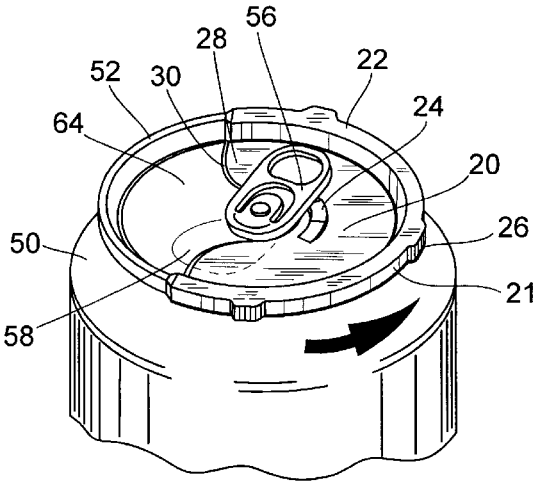
FIG. 10 is a diagram illustrating an en route operation of the present invention, in which the protective cover is being rotated to expose the drinking area of a beverage can.

FIG. 10 is an illustration of the rotary protecting cover being partly rotated to exposes the drinking area. The rotating of the protecting cover can be easily accomplished by gripping the grasping bodies 26 along the rim with fingers.

Figure 11:
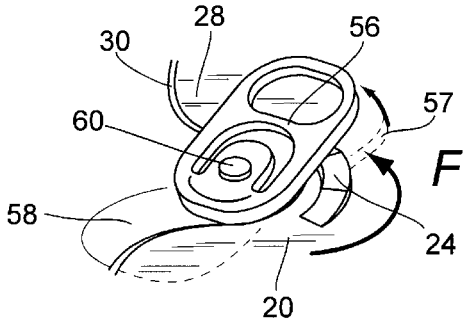
FIG. 11 is a sectional enlargement of FIG. 10, illustrating the lifting end of a punch key is being pushed upward by the built-in hill-shaped prying member located on the rotary protective cover surface.

FIG. 11 is a sectional enlargement of FIG. 10 to illustrate the end of the punch key 56 of the beverage can is being gradually pryed up to an elevated altitude from its original position 57 at the same time when the protecting cover 21 is being rotated. Due to the downwardly bending flip 28 of planar surface 20, which provided with beveled edges 30, the semi-circular disk shaped cover plate 20 can be easily slid beneath the punch key 56 in operation. The hill-shaped raised body 24, which is located near the center of the cover plate surface 20, has a radius generally centered on the rivet pin 60. Raised body 24 is characteristic in having an inclining plane with a minimum elevation at the primary position of the punch key 56 at both ends and a maximum elevation at the center. Raised member 56 is a prying element for pulling the free end of the punch key 56 upwardly upon rotating the dish cover. And prying action can be achieved by rotating the protective cover 21 either clockwise or counterclockwise.

Figure 12:
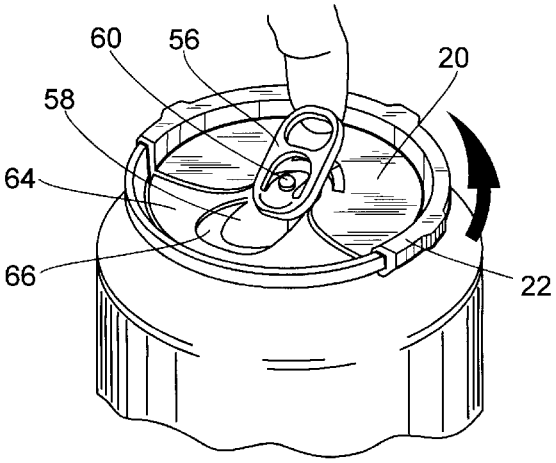
FIG. 12 is a diagram illustrating the operation of the present invention, in which the rotary protective cover has been turned to its full opened position to expose the drinking area. It also illustrates the partially lifted punch key can easily be accessed by a fingertip, pushing the perforated closure into the can interior.

FIG. 12 is a diagram to illustrate the protective cover 21 can be further rotated to reveal the whole drinking area which includes a portion of the can top that includes the perforated closure and a section of the raised rim of the beverage can. And since the drinking area is covered and protected by the rotary protective cover 21 until consumption, therefore, the drinking area remains clean from contamination prior to use. In addition, the widened gap between the punch key and the beverage can's top surface resulted from the prying action of the raised member 24 thus enables the punch key 56 to be accessed by a fingertip with ease. As operating in a conventional manner, the punch key 56, which is secured by the riveted assembly 60 on a beverage can top 64. Punch key 56 can be lifted at one end to exert leverage at its opposite end against the can top in order to punch out the perforated closure 58 into the can interior to create an opening 66 for drinking.

Figure 13:
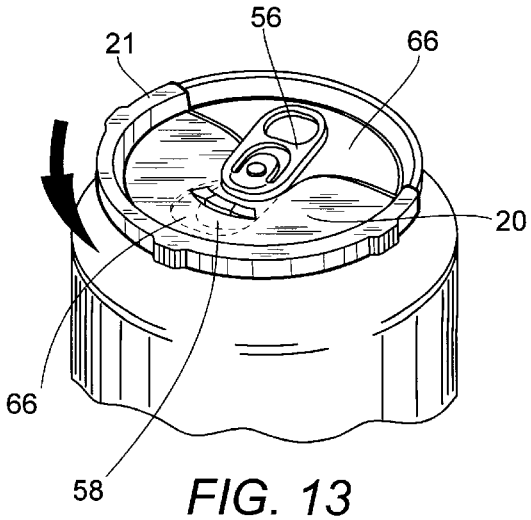
FIG. 13 is a diagram illustrating the protective cover is being rotated to a closed position to cover the opening of the can to prevent insects or other external contamination from entering the can's interior when not in use.

FIG. 13 is a diagram to illustrate the rotary protective cover 21 can be rotated to it's original position to cover the drinking area including opening 66 to prevent insects or other foreign contaminant from entering the interior of the beverage can.

Figure 14:
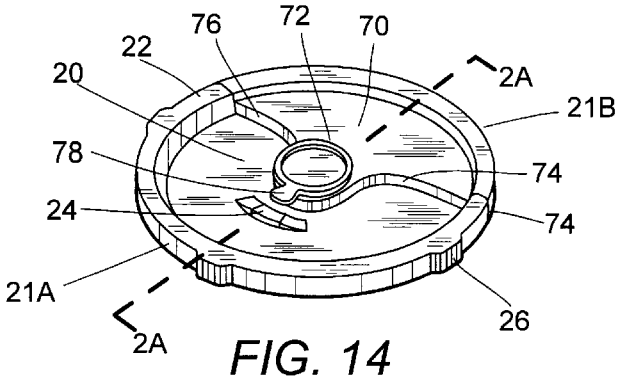
FIG. 14 is a perspective view of an alternate embodiment of the present invention, which includes an additional raised wall covered closure fragilely connected along the edge at the opening portion to form a complete circular protective cover.

FIG. 14 is a perspective diagram showing another alternative embodiment of the present invention. Referring to FIG. 14, the rotary full circular protective cover is a modification of the semi-circular cover dish 21 described above. In additional to the basic construction of a semi-circular cover plate here designated as 21A, a raised wall covered closure designated as 21B is fragilely connected at the edge along the opening portion of cover plate 21A to form a full circular cover for a beverage can top. The formation of a full circular cover thus offers a complete seal for the beverage can top and is therefore providing the optimal protection for sanitary means. Basically speaking, the raised-wall covered closure 21B can be peeled away by pulling at the pull-ring 72 of the closure to reveal the semi-circular cover 21A, while the basic portion of the protective covered closure remains bonded to the can lid. In other words, the remained portion referred as 21A bonding to the can lid is exactly the same in construction and operation as the semicircular dish cover 21 described above.

Figure 15:
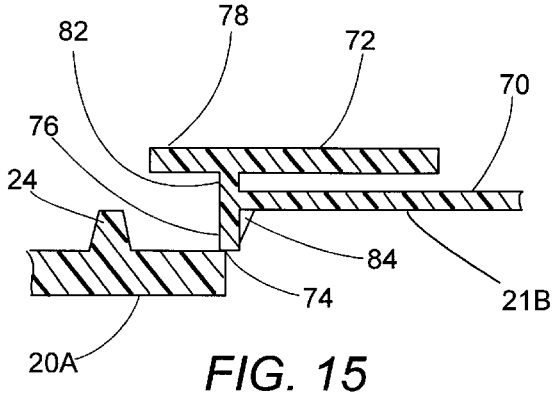
FIG. 15 is a cross-sectional view of the pull-ring assembly of FIG. 14 taken at line 2A, 2A showing the weak bond between the basic cover plate and the peel away covering portion.

FIG. 15 is essentially a sectional transversal illustration at the link between closure 21A and closure 21B which includes the pull-ring assembly. As shown in FIG. 15, a weak bond or flashing 74 is frangibly connecting at the lower periphery the basic closure 21A and the upper periphery of the raised wall closure 21B. Whereas raised wall closure 21B is about half the thickness of the basic closure 21A to facilitate easy separation from the basic closure 21A. Atop the midst of the raised wall 76 provided a pull-ring 72 is further linked by hinge 82. The free end of the pull-ring 72 can be tilted up by pressing downwardly at a thumb tab 78 which is an extended body at the opposite end of the pull-ring 72. The upwardly tilting of the pull-ring offers easy accessing for a fingertip. A triangular integral web 84 is located in an area behind raised wall 76 and beneath hinge 82. Reinforcing web 84 functions to localize the upward pulling force on the fragile flashing 74.

Figure 16:
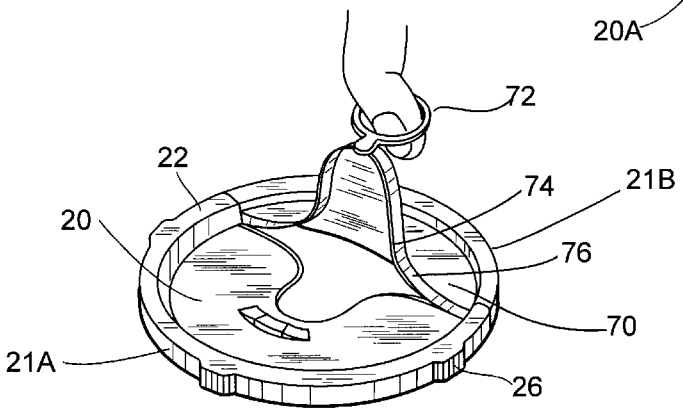
FIG. 16 is an illustration showing that the fragilely attached raised wall-covering portion is being pulled apart from the basic protective cover.
Figure 17:
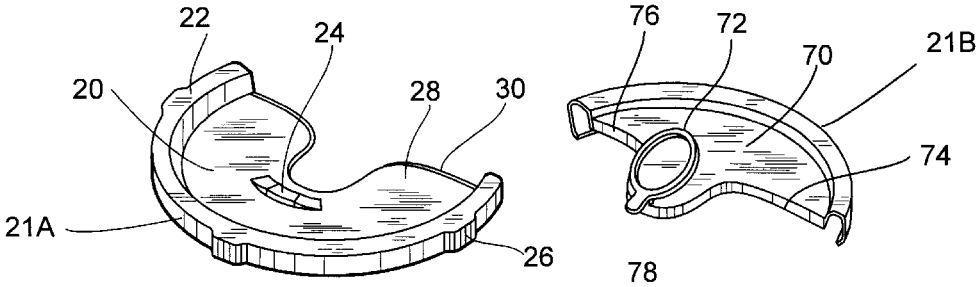
FIG. 17 is an illustration showing the two separated covering pieces, which includes the basic rotary protective cover and the raised wall-covering portion after separation is completed.

When ring 72 is pulled upwardly, as shown in FIG. 16, there is a tendency for the entire upward force to be distributed around the circumference of raised wall 76. By the introduction of reinforcement 84, the pulling force is concentrated at its location. This tends to ensure that ripping or tearing of the fragile flashing 74 will commence at the location near and just below reinforcement web 84. By concentrating the upward pulling force to this area, the flashing 74 will always rupture prior to the upward pulling force, thus pulling the entire closure 21B off the container as shown in FIG. 17.

The detailed description above in connection with the appended drawings is intended as a description of the present preferred embodiment of the invention, and is not represented as the only form in which the present invention may be constructed or utilized. The description sets forth the functions and operating the invention in connection with the illustrated embodiment. It is to be understood, however, that the same of equivalent functions and sequences may be accomplished by different embodiments that are also intended to be encompassed within the spirit and scope of the present invention.

I claim:

1. A rotatable protective one-piece circular cover attache on the raised rim of a beverage can top be being charterized in that:

said circular protective cover attachment having a depressed planar surface including a detachable raise-wall cover that can be peeled away to reveal a notch or an opening for the mouth to consume the contents of the container, wherein said detachable section is defined as having the lowest portion at the peripheral region of the said raise-wall closure frangibly secured by flashing to an uppermost portion of a cutout or an opening to be revealed, said raised-wall cover closure is about half the thickness of the depressed planar surface, whereby said raise-well cover provides flexibility for removal, said raise-wall cover provides a pull-ring assembly having a hinge-joint to one peripheral region of said raise-wall cover closure wall, where said raise-wall closure can be peeled away by pulling the pull-ring, said pull-ring assembly includes a thumb tab, which is an extension of the pull-ring, whereby said thumb tab can be pressed downward to lift the opposite end of said pull-ring.

2. The rotatable circular protective cover attachment of claim 1 wherein said protective cover attachment provides an up-standing annular recess disposed about the periphery for receiving and for gripping under the beaded edge or the rim portion of a beverage can, said recess being arranged to fit tightly while permitting said protective cover attachment to be rotatable about the rim, whereby said circular dish-shaped protective cover can be pressed onto the can from above like a snap-on cap over the rim of a conventional beverage can top.

3. The rotatable circular protective cover attachment of claim 2 provides a gradual elevating projection from the depressed planar surface, wherein said gradual elevating projection is defined as a hill-shaped projection having an inclining plane originating with a minimum elevation at both primary ends and a maximum at the center, whereby said gradual projection is a method to assist in lifting the free end of the punch key to an elevated altitude upon rotation of said protective cover, whereby prying action can be achieved by rotating said protective cover either clockwise or counter-clockwise.

4. The rotatable circular protective cover of claim 3 wherein said circular cover forms a predetermined shaped notch or opening fully extending to the edge of a beverage can upon removal of the said-wall cover closure by pulling the pull-ring, whereby said notched circular protective cover can be rotated about the rim of the can to provide a drinking position and a sealed position.

5. The rotatable circular protective cover of claim 4 wherein said predetermined shaped notch or opening includes a cutout at the center to align with the punch key of a beverage can and extends to a gradual widened curved cutout to fit the mouth.

6. The notched or opened rotatable circular protective cover of claim 5 wherein said gradual widened curved opening forms a flap at each side wherein said flaps slightly bend downward to press against the top lid surface of a beverage can, whereby said downward bending flaps can be slipped to the underside of a punch key easily during rotation.

* * * * *